US005226207A

United States Patent [19]

Elzaurdia

[11] Patent Number: 5,226,207

[45] Date of Patent: Jul. 13, 1993

[54] SEWER UNCLOGGER

[76] Inventor: William Elzaurdia, 433 Broadview, Highland Park, Ill. 60035

[21] Appl. No.: 811,289

[22] Filed: Dec. 20, 1991

[51] Int. Cl.[5] ..... B08B 9/02

[52] U.S. Cl. ..... 15/104.31; 15/104.09; 15/104.32; 15/104.33

[58] Field of Search ..... 15/104.09, 104.12, 104.13, 15/104.14, 104.31, 104.33, 104.11, 104.32

[56] References Cited

U.S. PATENT DOCUMENTS

| | | | |
|---|---|---|---|
| 508,380 | 11/1893 | Gardner . | |
| 1,693,115 | 11/1928 | Jacobus | 15/104.11 |
| 1,929,387 | 10/1933 | Montgomery | 15/104.07 |
| 1,933,624 | 11/1933 | Guthrie | 15/104.09 |
| 1,976,990 | 10/1934 | Guthrie . | |
| 2,061,864 | 11/1936 | Wells . | |
| 2,178,801 | 11/1939 | Mattern et al. | 15/104.12 |
| 2,497,659 | 2/1950 | Davis et al. . | |
| 2,692,752 | 10/1954 | Heiss | 15/104.12 |
| 2,818,591 | 1/1958 | Joynes | 15/104.31 |
| 2,917,762 | 12/1959 | Xenis | 15/104.05 |
| 4,418,437 | 12/1983 | French | 15/104.09 |
| 4,516,286 | 5/1985 | Crane | 15/104.12 |
| 4,766,631 | 8/1988 | Crane et al. | 15/104.12 |
| 4,773,115 | 9/1988 | Smith | 15/104.31 |

OTHER PUBLICATIONS

Allan J. Coleman Co. Rigid Tool Catalog No. RT-580, pp. 88-111.

*Primary Examiner*—Edward L. Roberts
*Attorney, Agent, or Firm*—Hill, Steadman & Simpson

[57] ABSTRACT

A sewer unclogger having a small motor at its leading end and a length of coiled rod or a snake for pushing the motor through a clogged sewer pipe, the motor having at its lead end a grapple hook or a cutter for removing the clog. When a grapple hook is used, the rotating motor rotates the grapple hook until it grabs onto the obstruction, wherein the motor can be disengaged from the rod or shut off and the rod used to retract the motor grapple hook and obstruction from clogging the pipe. Various embodiments are described including a pneumatically driven motor which uses a pneumatic tubing to both supply compressed air and to serve as the snake for pushing the motor through the pipe, a battery pack motor, and a electric motor where a common electrical conductor and rod are used to both supply electric power and push the electric motor through the pipe.

31 Claims, 2 Drawing Sheets

10
14
20
24
30
34
40
42
44
48
50
52
56
58
60
62
66
67
67a
68
70
72
73
74
100
104
106
48a
III
V
S

FIG. 5
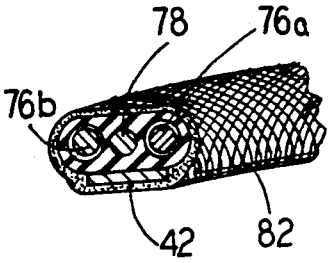
FIG. 6
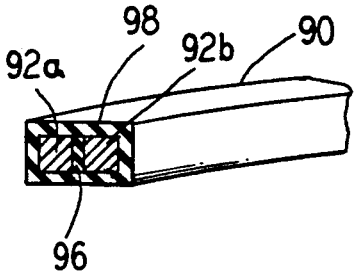
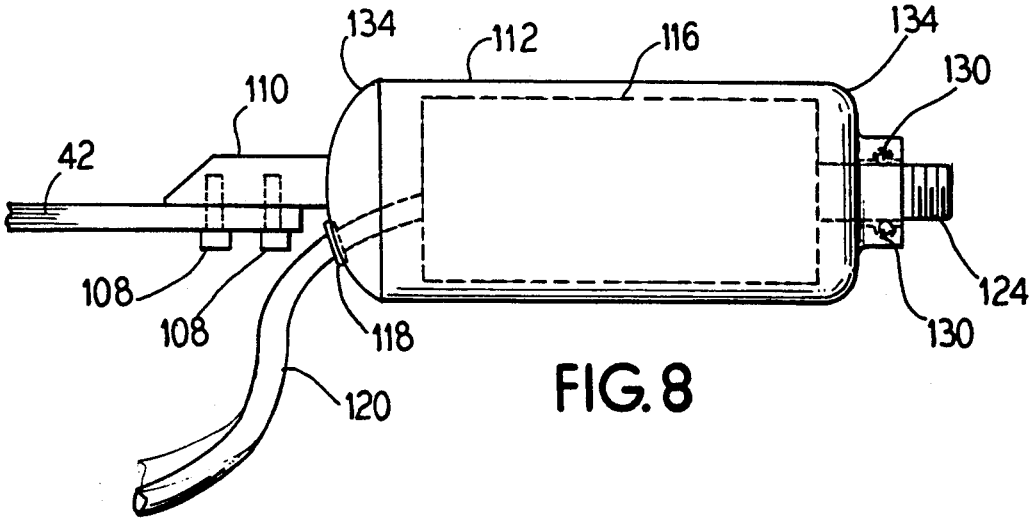
FIG. 8

SEWER UNCLOGGER

BACKGROUND OF THE INVENTION

This invention relates to an apparatus for unclogging clogged sewer lines or pipe lines. More particularly, this invention relates to a tool which can be threaded or "snaked" through a pipe having bends and which tool provides at its distal end a clog grappling, or cutting device or a pipe cleaning device including a motor for rotating the cutting or grappling or cleaning device.

It is known in the prior art to provide a sewer cleaning device mounted on skids and pushed through the sewer, wherein the sewer cleaning device has a hydraulic motor, using high pressure water, for rotating and cutting to clean the sewer. Such a device is disclosed in U.S. Pat. No. 4,766,631 and U.S. Pat. No. 4,516,286. It is also known to provide rotating brushes or cutters driven by an electric motor for moving through a pipe for cleaning This is disclosed in U.S. Pat. Nos. 2,497,659, 2,061,864, 508,380, and 4,773,115.

It is also known to provide a grapple hook or cutter or other tool connected to a distal or leading end of a snake or rod wherein the snake or rod is connected to a rotation source outside of the pipe. This rotation source can either be a hand crank or a motor of some sort. In known embodiments the motor or crank must rotate not only the grapple or cutter, but the entire length of the snake or rod which is forced through the pipe. For these embodiments, a coiled snake is generally used for rotation. Because the coiled snake must have sufficient tensile strength for pulling out or retraction, it is generally heavier than a comparably strong flat bar tape. On the other hand, flat bar tapes resist twisting more than coils so are generally not preferred in the known arrangement where ease of rotation of the entire snake and grapple is required.

However, it is novel to provide a small electric motor mounting a grapple hook, cutter, or cleaner the electric motor pushed through the sewer or pipe by a rod or snake. It is also novel to provide a small pneumatically driven motor in place of the electric motor with a pneumatic tube serving the function of supplying compressed air to the pneumatic motor and also acting as the snake or pushing rod to thread the pneumatic motor through the pipe.

By placing the motor or rotator into the pipe a flat bar tape can be used more effectively since it need not rotate and in fact preferably provides resistance to rotation. Flat bar tapes are less expensive and have greater tensile strength for the same weight as coiled snakes.

SUMMARY OF THE INVENTION

It is an object of the present invention to provide an sewer unclogger which is effective, readily manufacturable, and cost effective so that a typical homeowner could purchase such a device without the expensive outlay of the industrial sewer unclogger systems known. It is an object of the invention to provide a snake or rod system for threading through a pipe, the pipe possibly having bends, and providing at a distal end of the snake a motor driven grapple, cutter, or other tool which can either seize or cut the obstruction or clog or clean the pipe. It is an object of the present invention to provide that the rod or snake need not be rotated about its axis but may merely serve the function of translation along its length to position the motor driven grapple or cutter through the pipe against the obstruction. By providing that the snake or rod need not rotate about its axis, a smaller motor can be provided than the known motor driver which rotates both the grapple hook or tool and the snake, the known motor placed outside of the pipe. It is an object of the invention to provide a sewer unclogging system which can be purchased by the typical homeowner, which does not require a supply of high pressure water and water piping and fittings to operate. By providing, in at least one embodiment, that the snake and motor driven grapple are electrically operated, the typical homeowner need do no more than plug in the apparatus to a wall socket.

The invention provides in one embodiment that the motor driven grapple or cutter or tool has a battery pack mounted integral therewith and the battery pack/motor driven tool is connected at a distal end of a snake or rod for threading through the pipe. In another embodiment of the invention the battery pack is not used and the snake or rod is accompanied along its length by power supply conductors. The power supply conductors can be formed integral with the snake or rod for simplicity or the snake or rod itself could act as the power supply conductors as shown in an alternate embodiment. In another embodiment of the invention the electric motor is replaced by a pneumatic motor and the rod or snake is replaced with a pneumatic tube of sufficient flexibility and stiffness to act as the snake or rod to push the pneumatic motor and grapple or cutter through the pipe to the source of obstruction.

BRIEF DESCRIPTION OF THE DRAWINGS

FIG. 5 is a sectional view taken generally along V—V of FIG. 4;

FIG. 6 is a sectional view of an alternate embodiment of the rod of FIG. 4;

FIG. 8 is a side elevational view of a third alternate embodiment of the present invention.

DETAILED DESCRIPTION OF THE PREFERRED EMBODIMENTS

Figures 1, 2, 3, 4, 7:
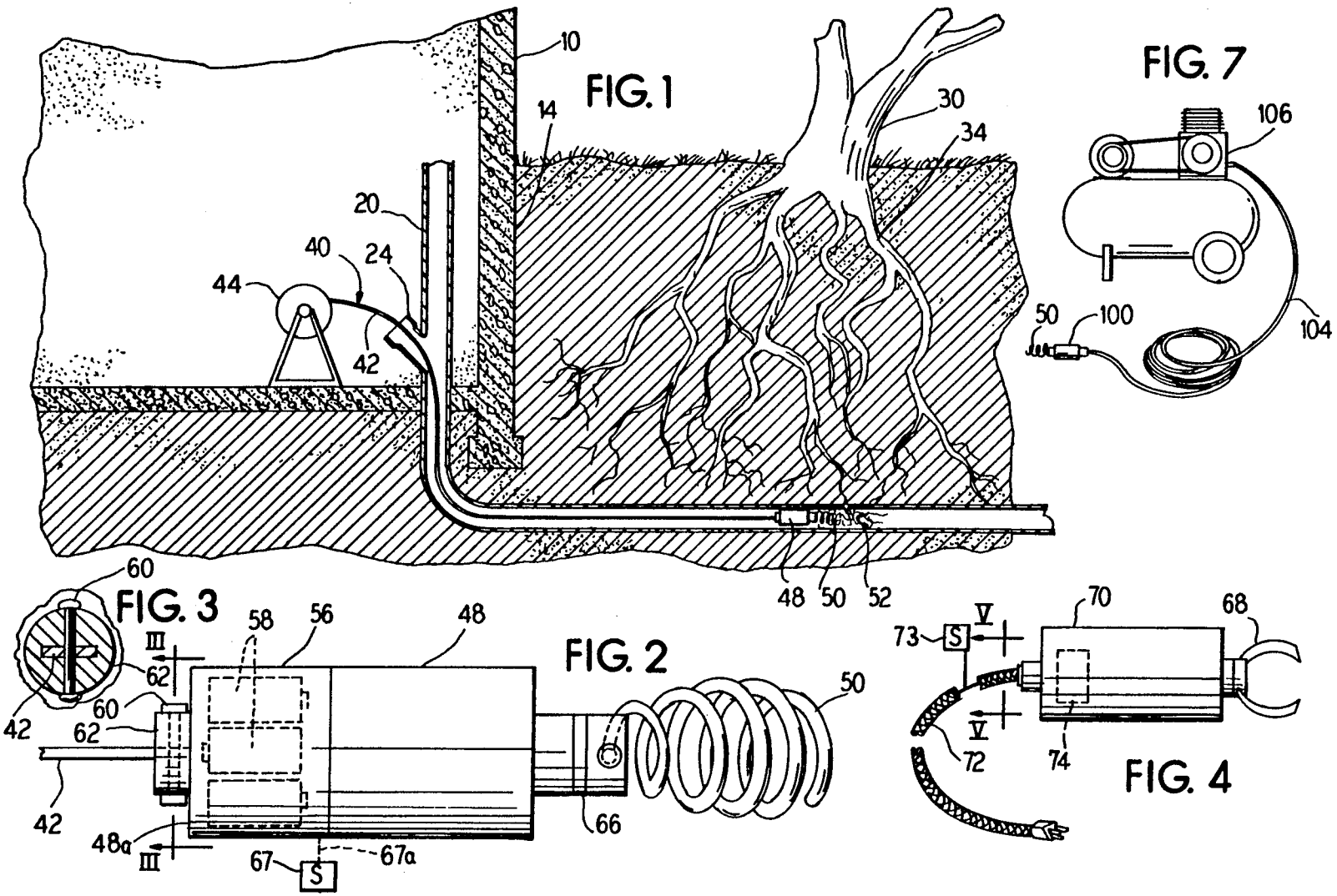
FIG. 1 is a sectional view showing the application of the present invention, including a rod driven motor having a grapple hook threaded through a pipe.
FIG. 2 is a elevational view of the motor shown in FIG. 1.
FIG. 3 is a sectional view taken generally along III—III of FIG. 2.
FIG. 4 is a elevational view of an alternate embodiment of the device of FIG. 1.
FIG. 7 is perspective view of a second alternate embodiment of the device of FIG. 1.

FIG. 1 shows a house at 10 having subgrade walls 14 and a sewer line 20 having a clean out lateral 24. The sewer 20 proceeds beneath the house 10 to a destination such as to a community sewer line. A tree 30 outside of the house 10 proceeds downwardly with roots 34. It is a known phenomenon that roots 34 can break into or grow into cracks in the sewer line 20, particularly when the sewer line 20 is of a jointed type where joints can become loosened or a brittle type which can become cracked because of uneven settling or other disturbances.

The apparatus of the present invention is designated at 40. The apparatus 40 includes a spooled snake or tape or rod 42 wrapped into a spool 44 and at a distal end attached to a motor 48. In use, the motor 48 is snaked through the sewer 20 by pushing the rod 42 through the sewer 20. The rod 42 has sufficient flexibility and stiffness to navigate corners in the pipe 20 and still be susceptible to pushing from outside the pipe 20. A flat bar tape is ideal as it resists counter rotation by the motor 48 when seizing a clog or root and has sufficient flexibility and strength, more so than an equivalent weight coiled snake. An optional lightweight system can thus be provided for carrying, handling, and use by a nonprofessional homeowner.

Mounted at a leading end of the motor 48 is a tool such as a grapple 50 which resembles a coiled spring. The grapple 50 is axially rotated by the motor 48. The grapple 50 is configured to engage an obstruction or blockage 52 and entangle the obstruction by rotating movement of the grapple 50. When the obstruction 52 is roots or solid sewage matter the grapple 50 can either disturb the blockage so as to flush through the pipe or grabs onto the blockage. Once entangled in the grapple 50 the motor 48 can be turned off and a retractive force exerted on the rod 42 by the user to pull free the obstruction.

The motor 48 can be "turned off" by a number of known means such as a torque limiting switch, a slip type clutch, manually, a current overload switch on the motor, etc.

FIG. 2 shows a close up view of the motor 48 and the grapple 50. In one embodiment, the motor 48 consists of a battery pack 56 having batteries 58 arranged therein. The rod 42 is mounted to the motor 48 at a rear end 48*a* thereof by a pinned arrangement. A pin 60 proceeds through a collar 62 to pierce the rod 42 and hold it to the motor 48. A slip clutch 66 is shown schematically between the motor 48 and grapple 50 which would serve the function of allowing the motor to continue turning when the grapple 50 is stopped by roots 34 or blockage 52. A control switch 67 is shown schematically which can be wired from outside the pipe, through the pipe via wire 67*a* to the batteries 58 to cut power to the motor 48 or to reverse the motor 48 depending on the resistance of the root or clog.

Alternatively, the grapple hook 50 can have an intentional weakness to cause the hook 50 to break off when the hook grabs a root too thick for the user to retract via the snake 42. This way, the relatively inexpensive hook 50 is sacrificed to save the motor 48, i.e., the motor can be withdrawn.

FIG. 4 shows an alternate embodiment wherein the grapple 50 has been replaced by a cutting head 68 which, rather than entangle up an obstruction, acts to cut through the obstruction, be the obstruction garbage or roots 34 from the tree 30. A grapple hook 50 or other tool could also be used in this embodiment. An alternate motor 70 is provided which needs no battery pack, but which is instead powered from an external source through a power cord 72. A selectable forward/reverse/off switch 73 is provided outside the pipe to rotate the motor or to reverse the motor to disengage from an immovable clog or root if necessary. A break switch 74 is shown schematically for shutting off the motor when the cutter 68, or alternatively, the grapple 50 or other tool is stopped or seized by the clog. FIG. 5 shows one embodiment of the power cord, wherein a first and second conductor 76*a*, 76*b* respectively, and a ground wire 78 are provided mounted integrally with the rod 42 and the components covered in a common casing 82. The conductor 76*a*, 76*b* and the ground wire 78 correspond to the typical three-pronged power plug 86 as shown in FIG. 4.

FIG. 6 shows an alternate embodiment of the power cable 72 referred to as the lead 90 which features at least two conductors 92*a*, 92*b* which also acts as the rod or snake. The conductors 92*a*, 92*b* are separated by an insulator 96 and covered by an insulating cover 98.

The conductors 92*a*, 92*b* are shown in flat bar shape, but a round shape could be used as well. By using the snake or rod 90 as both the pushing modem and the electrical conducting medium an efficiency of space and materials is achieved.

FIG. 7 shows an alternate embodiment of the present invention, wherein instead of an electrically powered motor, a pneumatically powered motor 100 is used. A pneumatic tube 104 is utilized which has the required stiffness and flexibility to snake the tube 104 throughout the pipe and still achieve a pushing force on the pneumatic motor 100. A compressor 106 is shown to power the pneumatic motor 100 through the pneumatic tube 104 from outside of the pipe.

The electric motor 48, 70 shown in FIGS. 1–4 should be a sealed electric motor for underwater service.

FIG. 8 shows a typical construction with alternate features. The snake 42 is shown as a flat bar tape bolted with two cap screws 108 to a lug 110 mounted to a casing 112. The casing 112 holds sealed therein a motor 116. The casing is sealed at an entrance 118 for a power cord 120 sealed and at an output shaft 124. An O-ring 130 is used at the output shaft. The casing has rounded shoulders 134 at both ends for smooth, reduced resistance for insertion and retraction through clogged pipes. In the preferred embodiment the casing 112 can be sized no larger than a flashlight with sufficient maneuverability through the pipe.

Although the present invention has been described with reference to a specific embodiment, those of skill in the art will recognize that changes may be made thereto without departing from the scope and spirit of the invention as set forth in the appended claims.

I claim as my invention:

1. A sewer unclogger comprising:

an electric motor sized to be accepted within a sewer to be unclogged;

an elongate rod member of sufficient flexibility and stiffness to thread through a sewer pipe, said rod attached to a trailing end of said electric motor; and means for using rotary movement to disturb a clog in the sewer, the means mounted to an output shaft of said motor at a lead end of said motor.

2. The sewer unclogger of claim 1, wherein said means comprise a grapple for grasping said clog.

3. The sewer unclogger of claim 2, wherein said grapple is designed to fail before failure of either said rod or said motor upon applying a withdrawal force on said rod after engagement with a clog which is immovable at said withdrawal force.

4. The sewer unclogger of claim 2 further comprising a torque limiting switch electrically connected to said motor to shut down said electric motor upon seizure of said grapple with said clog.

5. The sewer unclogger of claim 2 further comprising a current overload switch electrically connected to said motor to shut down said electric motor upon seizure of said grapple with said clog.

6. The sewer unclogger of claim 1, wherein said motor comprises an integral battery pack for powering the motor, and said unclogger further comprises a slip clutch between said means and said output shaft.

7. The sewer unclogger of claim 6, wherein said means comprises a grapple.

8. The sewer unclogger of claim 1, wherein said means comprises a cutting tool for cutting through said clog.

9. The sewer unclogger of claim 1, further comprising an integral battery pack for powering said electric motor.

10. The sewer unclogger of claim 1, further comprising an on/off switch located remote from said pipe and wired to said motor.

11. The sewer unclogger of claim 10 further comprising a forward/reverse rotation switch located remote from said pipe and wired to said motor.

12. The sewer unclogger of claim 1, wherein said rod comprises at least one conductor for providing electric power to said motor.

13. The sewer unclogger of claim 12, wherein said rod comprises two conductors and said conductors terminate in an electrical household plug.

14. The sewer unclogger of claim 13, wherein said rod comprises a bar-shaped tape member and said conductors comprise separate electric wires and said tape member and said electric wires are covered in a common casing.

15. The sewer unclogger of claim 13, wherein said conductors are bar-shaped and act as both electrical conductors and as said rod for pushing said electric motor through said pipe.

16. The sewer unclogger of claim 13, wherein said means comprise a grapple for grasping said clog.

17. The sewer unclogger of claim 13, wherein said means comprises a cutting tool for cutting through said clog.

18. The sewer unclogger of claim 13, wherein said conductors provide an on/off switch.

19. The sewer unclogger of claim 18, wherein said conductors provide a forward/reverse switch.

20. The sewer unclogger of claim 1 further comprising a slip clutch between said means and said output shaft.

21. The sewer unclogger of claim 1, wherein said unclogger further comprises an integral battery pack for powering the motor, and an electric switch to shut off said motor upon seizure of said means with said clog.

22. The sewer unclogger of claim 21, wherein said means comprises a grapple.

23. The sewer unclogger of claim 1, wherein said unclogger further comprises an integral battery pack for powering the motor, and said means comprises a grapple designed to fail before failure of either said rod or said motor upon applying withdrawal force on said rod after engagement with a clog which is immovable at said withdrawal force.

24. The sewer unclogger of claim 1, further comprising a shut off switch wired to said motor which senses seizure of said clog and shuts down said motor.

25. The sewer unclogger of claim 1, further comprising a spool and wherein a length of said elongate rod is wound around said spool.

26. The sewer unclogger of claim 1, further comprising means for disconnecting rotative power between said output shaft and said means for using rotary movement upon seizure of said clog.

27. The sewer unclogger of claim 26, wherein said means for disconnecting comprises a slip clutch mounted between said output shaft and said means for using rotary movement.

28. A sewer unclogger comprising:

a motor sized to be accepted within a sewer to be unclogged;

an elongate rod member of sufficient flexibility and stiffness to thread through a sewer pipe, said rod attached to a trailing end of said motor; and grapple means for seizing a clog in the sewer, the grapple means connected to an output shaft of said motor at a lead end of said motor; and wherein said motor comprises a pneumatic motor and said rod comprises a pneumatic tubing for both pushing said motor through said pipe and delivering compressed air to said pneumatic motor.

29. The sewer unclogger of claim 28, wherein said grapple means is designed to fail before failure of either said rod or said motor upon applying a withdrawal force on said rod after engagement with a clog which is immovable at said withdrawal force.

30. The sewer unclogger of claim 28, further comprising means for disconnecting rotative power between said output shaft and said grapple means upon seizure of said clog.

31. The sewer unclogger of claim 30, wherein said means for disconnecting comprises a slip clutch mounted between said output shaft and said grapple means.

* * * * *